US005237801A

United States Patent [19]

Hillam et al.

[11] Patent Number: 5,237,801

[45] Date of Patent: Aug. 24, 1993

[54] AUTOMATED UTENSIL PACKAGING SYSTEM

[75] Inventors: Mark E. Hillam, Boulder; Donald L. Stillman, Westminster; Harry J. Tiffany, Weldona, all of Colo.

[73] Assignee: Technistar Corporation, Longmont, Colo.

[21] Appl. No.: 766,197

[22] Filed: Sep. 26, 1991

[51] Int. Cl.[5] ..... B65B 5/10; B65B 25/00; B07B 13/05

[52] U.S. Cl. ..... 53/446; 53/238; 53/142; 53/474; 53/493

[58] Field of Search ..... 53/445, 446, 443, 238, 53/237, 251, 155, 143, 142, 504, 493; 209/636, 629, 939, 542, 540, 621

[56] References Cited

U.S. PATENT DOCUMENTS

| | | | |
|---|---|---|---|
| 3,804,270 | 4/1974 | Michaud et al. | 209/939 X |
| 3,888,351 | 6/1975 | Wilson | 209/636 X |
| 4,630,428 | 12/1986 | Lesch | 53/238 X |
| 4,744,469 | 5/1988 | Swallert | 209/636 |
| 4,750,621 | 6/1988 | Akesson et al. | 209/540 X |
| 4,881,356 | 11/1989 | Beezer et al. | 53/238 X |
| 5,019,112 | 5/1991 | Engelhardt et al. | 53/474 |

*Primary Examiner*—James F. Coan
*Attorney, Agent, or Firm*—Beaton & Swanson

[57] ABSTRACT

An automated apparatus and method for identifying, picking up, placing and packaging a plurality of different packaging a plurality of different types of items such as utensils. Utensils are deposited onto a conveyor belt system that separates clusters of utensils and transports them to an identification site where a vision system identifies them by type, location and orientation and to a pick-up site where they are selectively picked up and placed in a collection pan to form a desired utensil set. When the collection pan has a desired utensil set, it is emptied into a placement bucket on a movable bucket conveyor which transports the set to an automatic bagging machine. The set may be supplemented with napkins dispensed from an automated napkin dispenser or other with other items from other machines operatively connected to the system.

53 Claims, 9 Drawing Sheets

AUTOMATED UTENSIL PACKAGING SYSTEM

FIELD OF THE INVENTION

This invention relates to automated means for packaging eating utensils or other items into bags for storage and handling. The invention has particular utility in prepackaged food systems such as those used in airplane or train travel or in cafeterias.

BACKGROUND OF THE INVENTION

There is an increasing interest in automated packaging systems as labor costs rise and as robotic machines become more sophisticated. The interest is particularly keen in the area of food packaging where sanitation concerns are paramount.

An obstacle to automated packaging in the food processing field is the tendency for the objects to be packaged to have irregular shapes or orientations as they are arranged on a pick-up site such as a conveyor belt. This obstacle has been lessened with the advent of better computer aided vision recognition systems which examine the pick-up site with a video camera and then digitize and process the image to identify the objects and to determine their location and orientation. Such a method for use with a moving conveyor belt pick-up site is disclosed in U.S. Pat. No. 4,041,907.

Various methods for sorting utensils are common in the prior art. Many of these methods rely on the magnetic attraction of metal utensils to a magnet, including U.S. Pat. No. 4,744,469 by Swallert; U.S. Pat. No. 4,782,970 by Edwards; U.S. Pat. No. 4,706,818 by Zutell; U.S. Pat. No. 4,367,138 by Kustas; U.S. Pat. No. 3,926,792 by Buford; and U.S. Pat. No. 3,877,577 by Richard. Other methods use mechanical manipulation that causes utensils of different sizes and shapes to be routed to different sorting bins, including U.S. Pat. No. 4,954,250 by Weihe; U.S. Pat. No. 4,485,927 by Corsmeier; U.S. Pat. No. 3,956,109 by Dietsche; and U.S. Pat. No. 3,883,422 by Ettlinger.

A limitation on prior art methods utilizing mechanical sortation is that they do not operate except with the few utensil configurations for which they were designed. The use of the machines for other utensil configurations generally requires changes to the mechanical sortation design. Another limitation is that they will sort utensils by type, but then the sorted utensils generally must be recombined in some manner to be packaged as in a package containing a knife, fork and spoon. A limitation to the magnetic methods is that they generally do not sort by utensil type, but merely separate magnetic utensils from material which is not magnetic.

It can be seen that there is a need for a system that will sort utensils by type and in which the system is easily adaptable to accommodate utensils of various configurations. Preferably, the system would include a means for distributing the utensils in such a way as to maximize the sorting efficiency. Also, the system should combine the sorted utensils in a predetermined way and place the recombined sorted utensils in such a way to allow them to be packaged, preferably without the intermediate step of collecting utensils of a given type into a collection bin. The system could be coordinated with other machines to add other elements to the utensil package and to bag the package.

SUMMARY OF THE INVENTION

The present invention is an automated system of packaging utensils or other items. The utensils are deposited on a continuous closed loop conveyor. A spreading chute and differential travel rates along different conveyor segments tend to separate clustered items. A portion of the conveyor passes under one or more pick-up machines, each of which has a dedicated vision imaging and recognition system and a pick-up and placement mechanism. The vision imaging and recognition system identifies items by type, location and orientation and stores that information. The system instructs the pick-up and collection mechanism to pick up and place into a placement site one of each item that is required (such as a knife, fork and spoon). When the collection site has received a full package, the full package is dispensed into a packaging site. The packaging site may be a set of containers that receive other items such as napkins and that move continuously to an automated bagging machine where the full package is bagged.

DESCRIPTION OF THE PREFERRED EMBODIMENTS

Figure 1:
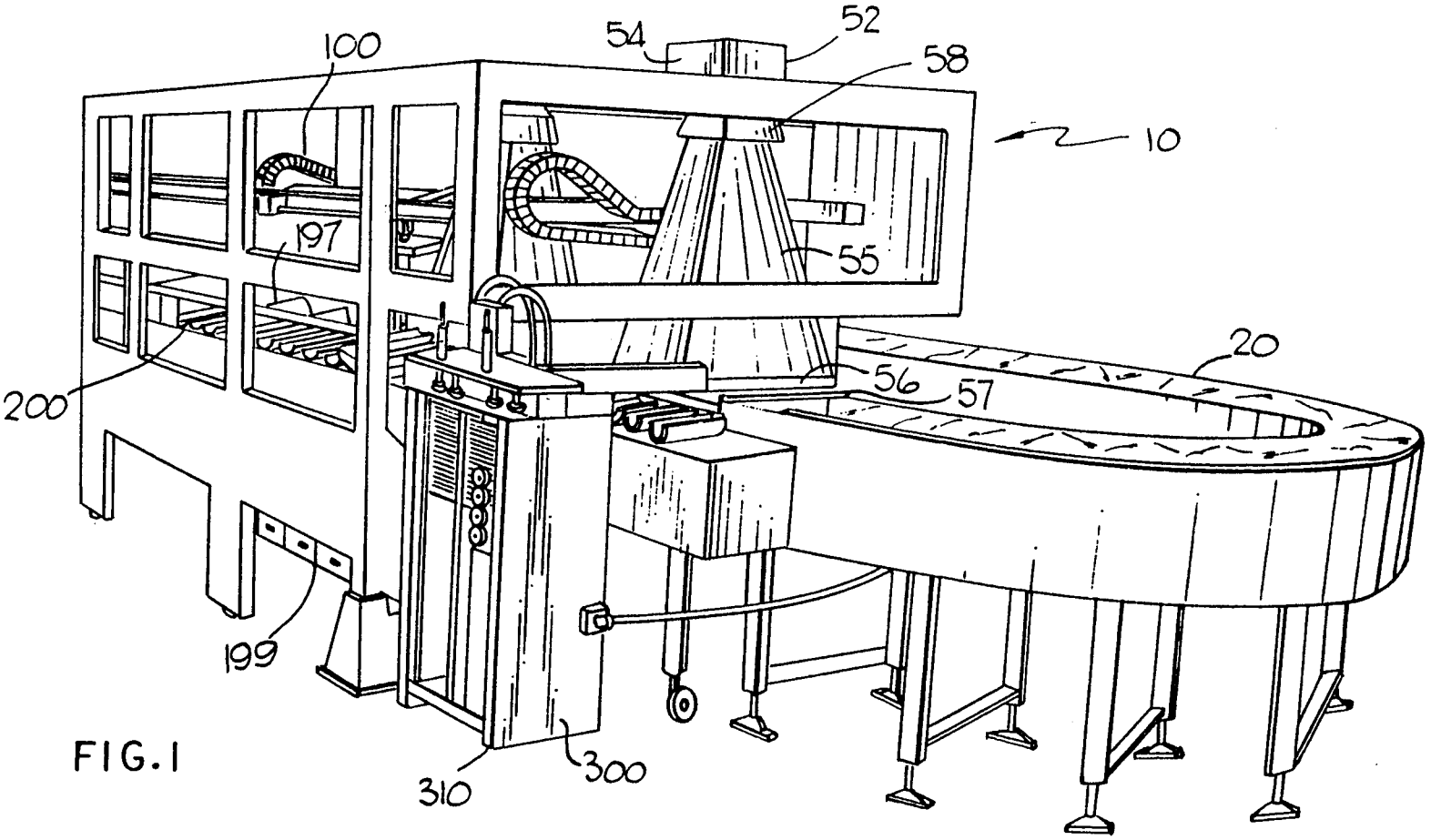
FIG. 1 shows an overall layout of a system constructed in accordance with the present invention, using two pick-up machines.

FIG. 1 shows an overall view of the system constructed in accordance with the present invention 10. The principal elements include a closed loop conveyor belt 20, a robotic pick-up machine 100, a placement bucket conveyor 200, an automated bucket filler such as a napkin dispenser 300 at the head of the bucket conveyor, and an automated bagger (not shown) at the end of the bucket conveyor. The preferred embodiment shown has a single pick-up machine and vision system, but additional pick-up machines and vision systems may be placed inline as described in more detail below.

Figure 2:
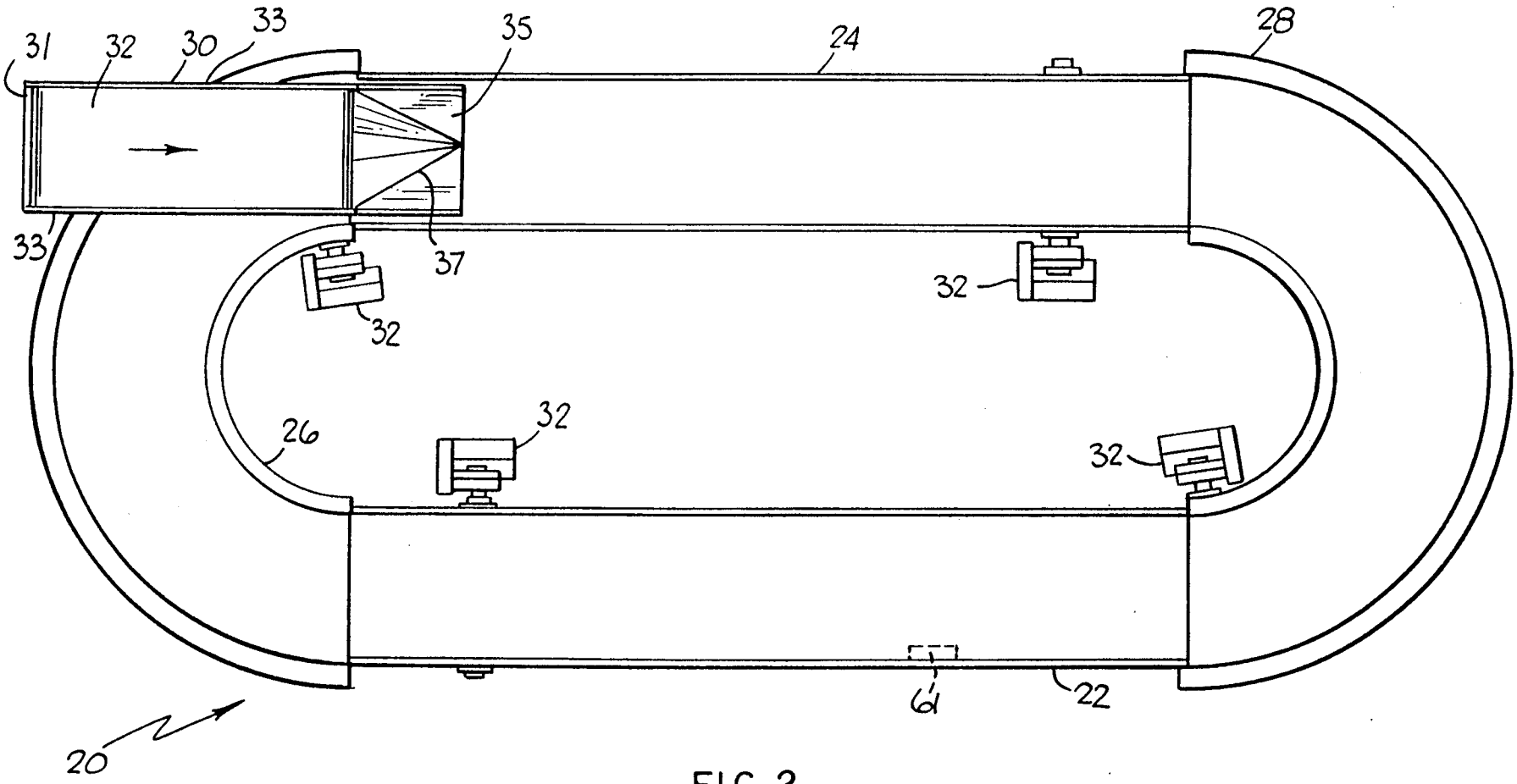
FIG. 2 shows the closed loop conveyor and infeed conveyor and infeed chute of the present invention.
Figure 3:
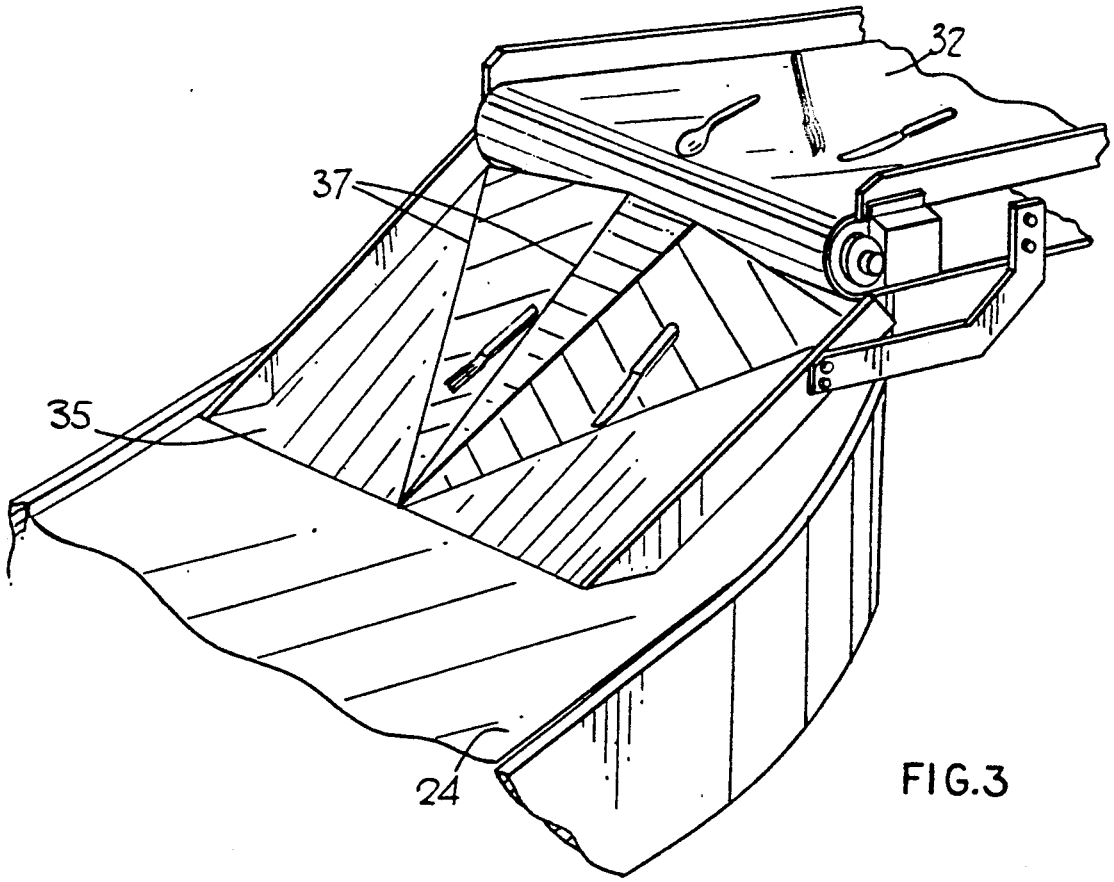
FIG. 3 is a perspective view of the infeed chute.

The closed loop conveyor belt 20 is shown in more detail in FIG. 2. The preferred embodiment is raceway-shaped and includes a front straightaway section 22, a back straightaway 24, a first curved portion 26, and a second curved portion 28, each of which is driven independently by a motor 32 or other suitable drive means.

The utensils are deposited onto the back straightaway section 24 by an upwardly inclined infeed conveyor 30 which receives manual dumps of utensils. The infeed conveyor may have its own motor, and may have a backstop 31 and sides 33 to prevent utensils from falling off. The infeed conveyor conveys the dumps of utensils to a downwardly sloped infeed chute 35. The utensils slide down the infeed chute onto the back straightaway section 24.

The conveyor belts are configured so that there is a drop-off from each element onto the next element; for example there is a drop-off of an inch or two from the first curved section onto the back straightaway and from the second curved section onto the front straightaway. In addition, the front straightaway and first curved section are driven at a faster linear speed than the back straightaway and second curved section, and the back straightaway and second curved section are driven at a faster speed than the infeed conveyor. Thus the several utensils in a cluster of utensils will fall from one conveyor onto the next conveyor at slightly different times so that the next conveyor which is moving at a faster speed than the last conveyor will tend to separate the cluster of utensils into individual utensils. This is all so that the vision system can more readily identify, locate and orient the individual utensils as explained in more detail below.

Figure 4:
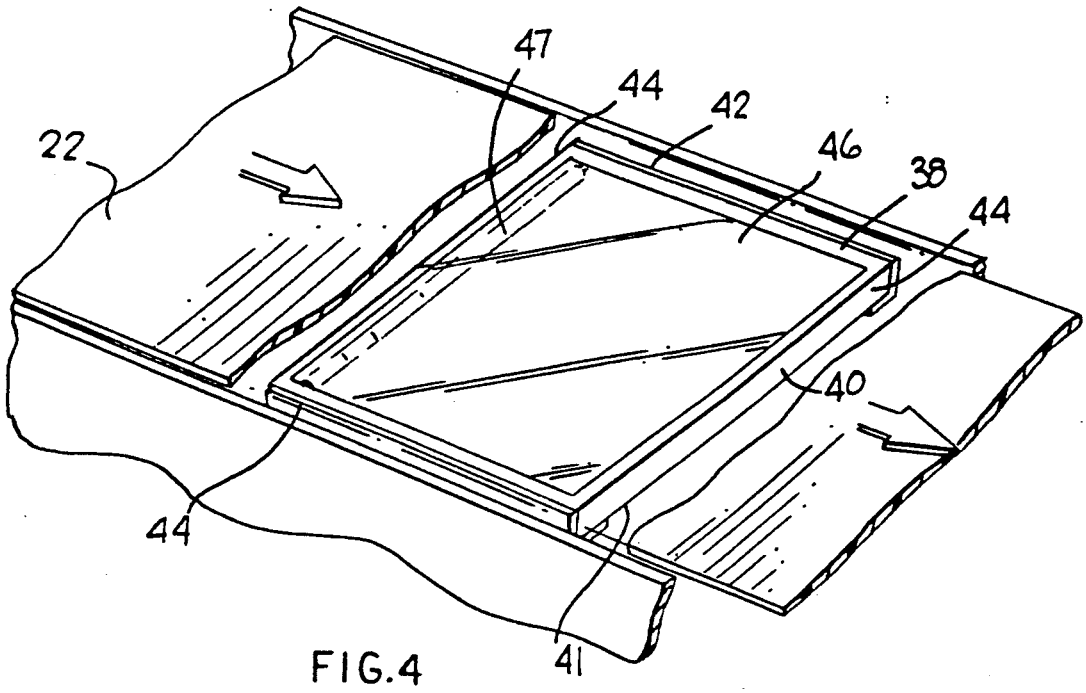
FIG. 4 is a perspective view of the light boxes used to back light the conveyor belt.

The front straightaway 22, which is positioned under the pick-up machines 100, may be translucent and backlighted with light boxes 38 to enhance the silhouette of the utensils. The light boxes 38 in the preferred embodiment are shown in detail in FIG. 4, and include a pan 40 having a width approximately the width of the portion of the conveyor belt over which the pick-up mechanism operates and a length roughly equal to the width. If there is only one pick-up machine used for the conveyor then the light box will normally be the width of the belt, but if there are multiple pick-up machines used for the conveyor and they operate over different belt widths then the light boxes will similarly operate over different belt widths. The pan 40 has a bottom 41 and a pair of longitudinal sides 42 in the belt longitudinal direction and a pair of lateral sides 44 in the belt lateral direction. The top of the pan is covered with a glass plate 46, and the belt 22 rides over the glass plate. At the corners between each lateral side 44 and the pan bottom 41 is a fiber optic light bar 41 (such as model nos. 2375-01 and 2375-02 by Fostec of Auburn, N.Y.) to which light is delivered by fiber optics (not shown). The fiber optics are attached to a strobe light to flash light into the light box and to transmit that light to the underside of the belt. It has been found that the light bar is preferably oriented so that the beam is 15° to 20° from horizontal for a light box that is about 2.25 inches deep in order to obtain suitable diffusion and transmission of the light.

A vision system 52 is mounted over the first straightaway section 22 as shown in FIG. 1. The vision system includes a video camera 54 directed toward the top of the belt 22 over the light box 38 and a light shield 55 to reduce undesirable shadows and reflections from the utensils. The light shield is a pyramidal shaped element having four sides that extend from a large bottom opening 56 that is positioned just above the belt to allow utensils to pass under it to a small upper opening 58 in visual communication with the video camera 54. The front and back of the light shield may have longitudinally extending flanges 57 to further reduce the transmission of light from the exterior of the box to the interior of the box, and the box interior may have a light-absorbing coating or may be painted black to maximize light absorption.

The bottom surface of the front straightaway section 22 of the belt 20 drives a friction wheel encoder 61 as shown in FIG. 2. The encoder 61 measures and records the belt movement and transmits the movement information to the computer so that the vision system can be coordinated with the pick-up machines in the manner described below.

In operation, it can be seen from the above description and the drawings that utensils are manually dumped onto the inclined infeed conveyor belt 30. The utensils are manually spread out on the conveyor belt 30 where they are dumped, and are of different types, locations and orientations. The infeed conveyor carries the cluster of dumped utensils upward and deposits them on the infeed chute 35. The utensils thereby slide down the feed chute and spread over the back straightaway 24 of the closed loop belt 20. The back straightaway 24 may be at a faster linear speed than the infeed belt 30, thereby spreading the utensils in the longitudinal direction. This spreading in the longitudinal direction helps to separate the cluster of dumped utensils.

The utensils then ride the back straightaway 24 to the second curved portion 28. A slight (less than an inch) drop-off from the back straightaway to the second curved portion will tend to further separate any remaining clusters. Yet another slight drop off, as well as a change to a faster linear speed, between the second curved portion and the front straightaway 22 separates the utensils still more.

The well-separated utensils are then carried on the front straightaway 22 to pass into the light shield 54 and over the light box 38. The strobe light activates periodically as explained in detail below so that the video camera can record the silhouettes of the back-lit utensils. The image is then processed to identify utensils by type, location and orientation using standard image recognition procedures that are known in the art but with the modification described below. The pick-up machines pick-up utensils and any unpicked utensils continue around the loop and the cycle is repeated for them.

Next described are the pick-up machines 100 with reference to FIGS. 4A–7. A single pick-up machine with its own vision system is used in the preferred embodiment shown, but it will be apparent that any number of pick-up machines each with its own vision system are possible depending on operating efficiencies and space limitations. A very large number of pick-up machines will be inefficient, however, because the density of utensils on the belt necessary to occupy all of the machines would cause the utensils to be too crowded and overlapping for the vision system to be effective.

Figure 4A:
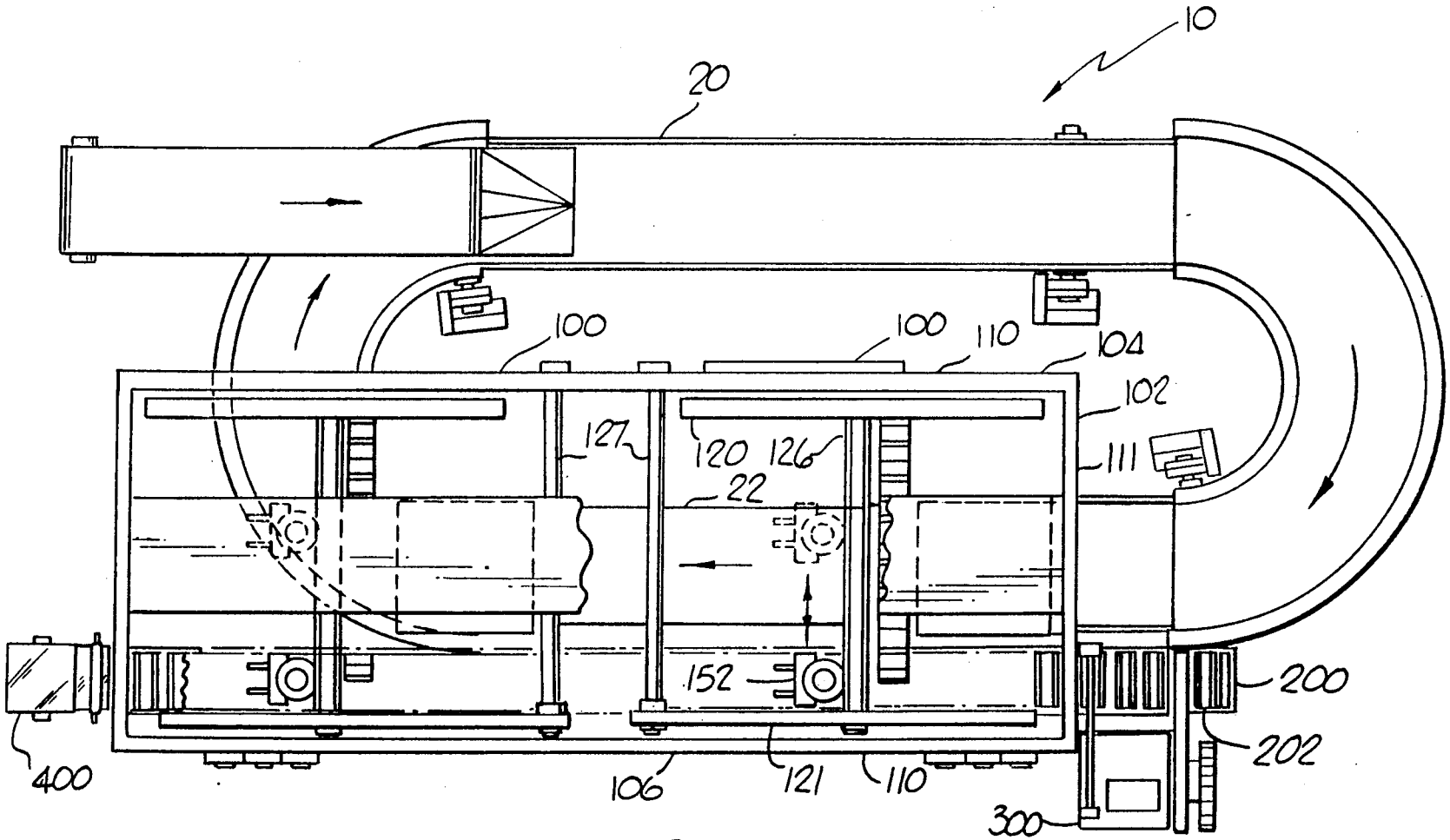
FIG. 4A is a top view of a pick-up machine of the present invention.

As shown in FIGS. 1 and 4A, the pick-up machine 100 includes a supporting frame 102 extending around and over the front straightaway section 22 of the closed loop belt 20. The frame 102 may be of any construction that will support the rest of the assembly, but in the preferred embodiment it has an inner frame section 104 and an outer frame section 106, each having a set of vertical members 108 and a set of longitudinal horizontal members 110. Connecting the inner frame section 104 and outer frame section 106 are a set of cross members 111 which extend across the belt 20. The cross members 111 may include a set of upper cross members 113 and a set of lower cross members 112. In the preferred embodiment, the frame is welded tubular steel with an appropriate protective finish.

Suspended from and welded or bolted to two adjacent top cross members 111 are downwardly extending struts 114. Two inner struts 114 are bolted to an inner longitudinal carriage 120, and two outer struts 114 are bolted to an outer longitudinal carriage 121. The inner longitudinal carriage 120 and outer longitudinal carriage 121 carry a lateral carriage 126 with each end of the lateral carriage bolted to the corner of one of the longitudinal carriages. The two longitudinal carriages 120, 121 are connected with a drive shaft so that the lateral carriage 126 is kept perpendicular and driven by a single motor. Bolted to the carrier of the lateral carriage 126 is the end effector assembly rotator 152. The individual carriages are of a type known in the art using a motor driven belt attached to a carrier mounted in a track. For example, model HLE-80 by Hauser in Pittsburgh, Pa. is used in the preferred embodiment.

The longitudinal and lateral carriages cooperate to move the end effector in the two perpendicular axes in the horizontal plane to position the end effector assembly 150 over various points on the belt 20. The carriages are computer controlled and coordinated with the vision recognition system through the belt encoder 61 which sends belt position information to the computer. Movement in the belt longitudinal direction is accomplished by movement of the longitudinal carriage carriers on the longitudinal carriages, and movement in the lateral direction is accomplished by movement of the lateral carriage carrier on the lateral carriage.

Figure 5:
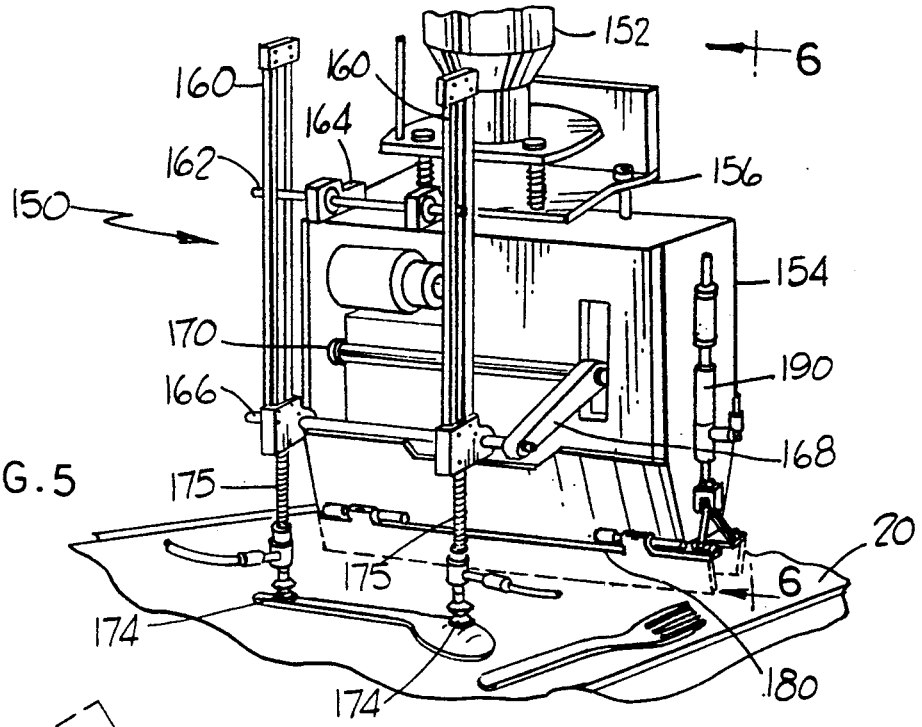
FIG. 5 is a perspective view showing the end effector assembly of the present invention.

The end effector assembly 150 is bolted to the carrier of the lateral carriage as shown in FIG. 5. The end effector assembly 150 includes an end effector assembly rotator 152 of a design known in the art. The rotator is a motor driven gear box that rotates the end effector assembly 150 about a rotator shaft. In the preferred embodiment, the rotator is model NE34-15-LB of Bayside Controls in Whitestone, N.Y.

Figure 6:
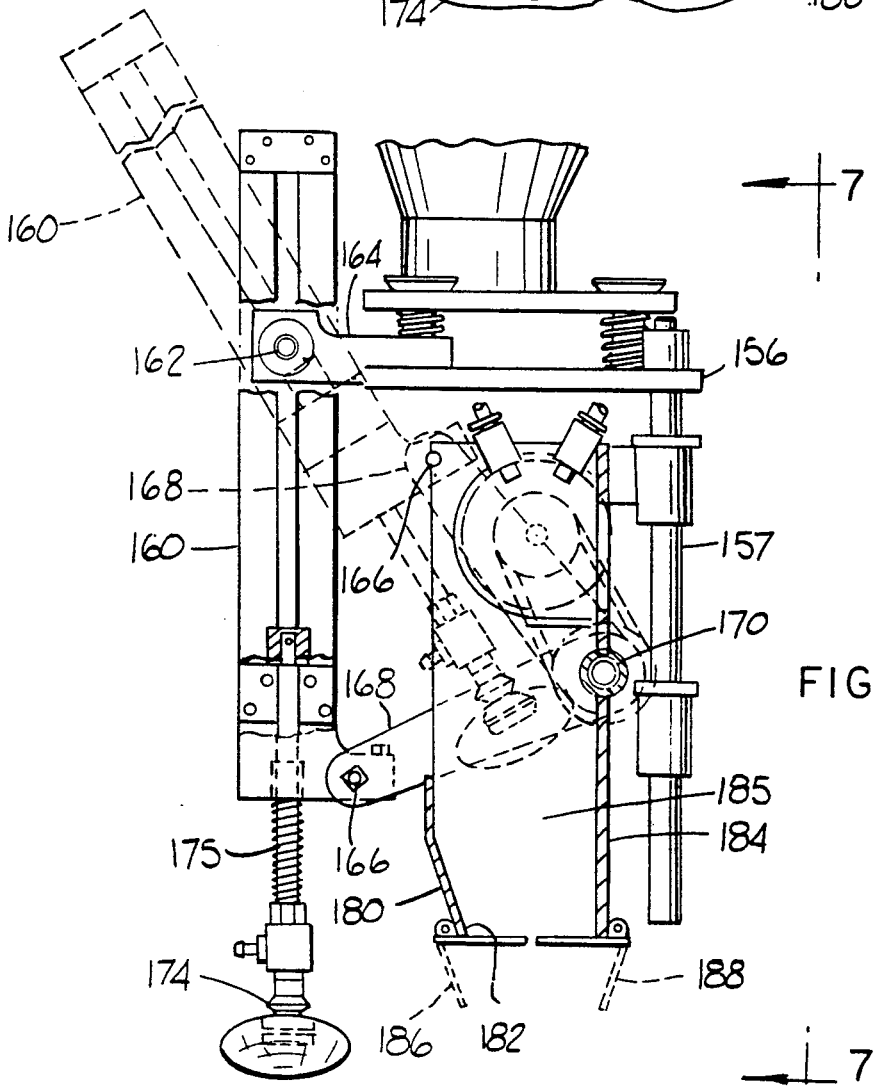
FIG. 6 shows an elevational view of the end effector assembly, taken along line 7—7 of FIG. 5, showing the collection pan trap doors in the open position.
Figure 7:
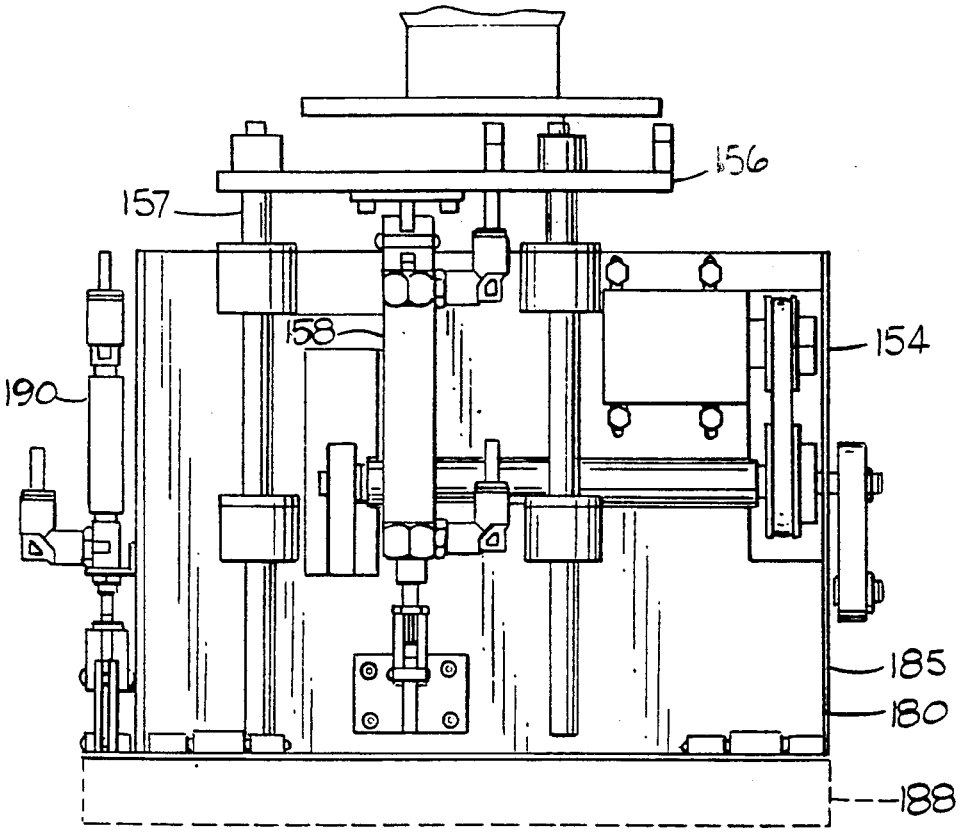
FIG. 7 is an elevational view of the end effector assembly, taken along line 7—7 of FIG. 6, showing the pneumatic struts for vertical positioning of the assembly.

As shown in detail in FIGS. 5-7, the end effector assembly 150 includes a housing 154 and a mounting plate 156 connected to the housing by vertical pneumatic struts 157 controlled by a vertical pneumatic strut cylinder 158. The mounting plate 156 is bolted to the bottom of the carrier of the lateral carriage. The operation of the vertical pneumatic struts accomplishes vertical adjustment of the end effector assembly in order raise and lower the end effector assembly over the conveyor belt 20. A pair of slotted actuator arms 160 are slidably and pivotally mounted on one side of the end effector assembly on an actuator arm pivot axle 162 which is attached to the housing 154 by an actuator arm bracket 164. At the bottom of the actuator arms 160 is a pivot rod 166 that is pivotally but not slidably mounted to the actuator arms. The pivot rod 166 is attached to pivot arm 168 that is mounted to the shaft 170 of a pneumatic pivot. It can be seen that the partial rotation of the shaft 170 causes the actuator arms 160 to slide up or down on the actuator arm pivot axle 162. When they slide up, the rotation of pivot arm 168 causes the pivot rod 166 to move closer to the housing 154, thereby skewing the actuator arms from vertical so that their bottom are closer to the housing than their tops. Stated another way, the pivot rod 166 follows an arced path from a lower outer position to an upper inner position.

Mounted to the bottom ends of the two actuator arms 160 are two vacuum end effector cups 174. The end effector cups are operated by vacuum hoses with electric valves to open and close the vacuum (not shown). The end effector cups are each mounted on independently compliant axial slides 175 and are preferably of a material that is resiliently deformable in the axial direction in order to pick up utensils of varying thicknesses as they lie on the belt. The vacuum system may include vacuum operated switches (not shown) to verify that the utensil pick-up operation is successful by sensing the reduction in air pressure in the system as the utensil closes the mouths of the end effector cups.

Upon selecting a utensil to be picked up through the vision system the end effector assembly 150 is positioned at the appropriate spot over the belt 20 by the longitudinal and lateral carriages 120, 121 and 126. The longitudinal positioning of the end effector assembly takes into consideration the longitudinal movement of the belt since the time the image was taken from which the utensil was selected, as determined by the encoder. The end effector assembly rotator 152 rotates the end effector assembly as required to orient the end effector cups 174 in preparation for picking up the selected utensil. The longitudinal carriages may also move the end effector assembly at the speed of the belt as the pick-up operation is performed, so that there is no relative motion between the utensil and the end effector cups. The pneumatic struts 156 are then operated by the pneumatic strut cylinder 158 to lower the end effector assembly 150 so that the end effector cups 174 make contact with the selected utensil. The vacuum valve (not shown) of the pre-existing vacuum system opens to actuate the end effector cups to attach the cups to the utensil. The pneumatic strut cylinder is then actuated in the opposite direction to raise the end effector assembly, thereby lifting the utensil from the belt. The pneumatic pivot then actuates to turn the shaft 170 and raise the pivot arms 162, thereby sliding the actuator arms 160 through their slots on the actuator arm pivot axle 162, to carry the end effector cups 174 through an arc upward and toward the housing 154. At the top of the arc, there is a stop in the pneumatic pivot to prevent further travel. The vacuum on the end effector cups 174 is then released to allow the utensil to drop.

A collection pan 180 is mounted to the housing bottom. The collection pan is positioned so that its open top is immediately under the end effector cups at the top of their upper position, and the pan receives the utensils dropped from the end effector cups. The collection pan includes two sidewalls 182 and 184 and it shares endwalls 185 with the endwalls of the end effector assembly housing 154. It has two hinged and mating trapdoors 186 and 188 that are controlled by a pneumatic door operator 190 (shown in FIGS. 5 and 7 but omitted for clarity from FIG. 6) attached to the bottom of the housing.

Figure 8:
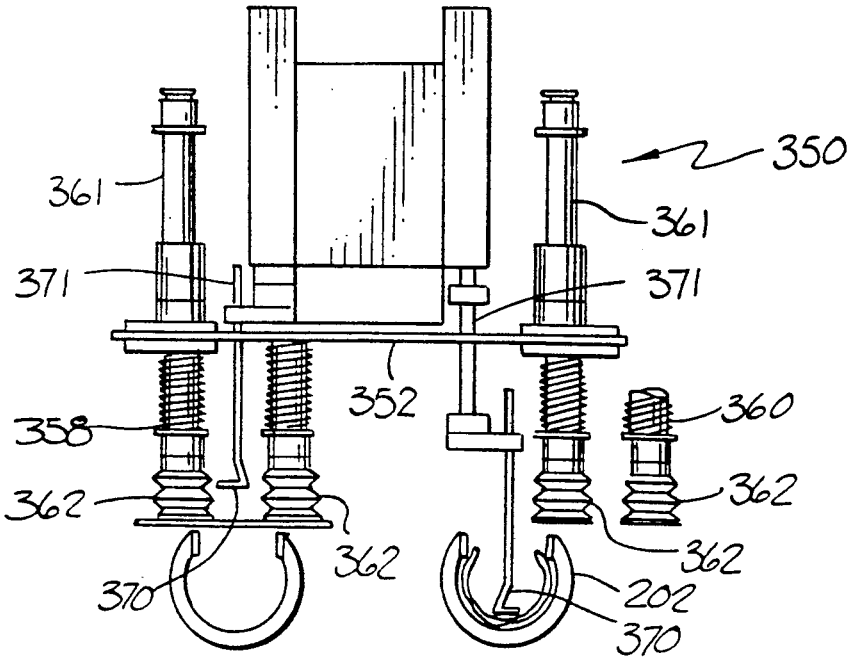
FIG. 8 is a front elevational view of the napkin dispenser end effector assembly.

Alongside the front straightaway portion 22 of the belt 20 is a set of open-ended cylindrical-shaped placement buckets 202 with an open top side that are carried on the bucket conveyor 200, as shown in FIGS. 1, 4A and 8. The bucket conveyor 200 and associated buckets are of a type known in the art for use with manual bucket filling. Briefly, the set of buckets 202 is carried by a motorized conveyor 200. The motor is activated by the same computer system that operates the vision system, conveyor belts and pick-up machines. The bucket conveyor 200 has an assigned collection point where empty buckets are to be filled with the utensils collected in the end effector assembly collection pan 180. This is done by moving the end effector assembly using the longitudinal and lateral carriages 120, 121 and 126 to position the collection pan over the bucket with the long dimension of the pan parallel to and directly over the long dimension of the bucket. The pneumatic door operator 190 then opens the trapdoors 186 and 188 to allow the collected utensils to drop into the buckets. The bucket conveyor 200 then advances the conveyor by one bucket so that a new empty bucket is available at the assigned collection point. The system can be programmed to pick up any number and kind of utensils and place them into the collection pan before releasing the collection of utensils from the collection pan.

A plurality of pick-up machines 100 may be placed in-line over the conveyor belts with each operating independently of each other and each having its own vision system. The downstream pick-up machines will receive only those utensils not already picked up by an upstream vision system. It is important to coordinate the pick-up machines to prevent any buckets from being filled twice. This can be done by assigning a repetitive sequence of buckets to the sequence of pick-up machines. For example, with two pick-up machines, each machine would use alternating buckets. With three pick-up machines each machine would use every third bucket, and so on, so that each bucket is assigned to one of the plurality of machines.

One or more of the pick-up machines 100 may be used to simply sort utensils by placing utensils of the same type into a container. In the embodiment shown in FIG. 1, there are a set of utensil chutes 197 located adjacent the belt, each of which is in communication with a utensil drawer 199. The pick-up machines can be instructed to pick up utensils of a recognizable type and deposit them into an assigned chute where they drop into the utensil drawer for removal. In this manner the utensils can be automatically sorted rather than collected into collections of several types for bagging. Such an approach is useful in, for example, sorting first class silverware that must be hand-wrapped in a cloth napkin. Alternatively, such an approach can be used in conjunction with the ordinary collection process by programming the system to both collect ordinary utensils and sort special utensils that are all on the same belt. Finally, in an embodiment utilizing a plurality of pick-up machines, some of the machines can be used to collect ordinary utensils and other machines can be used to sort special utensils.

Figure 9:
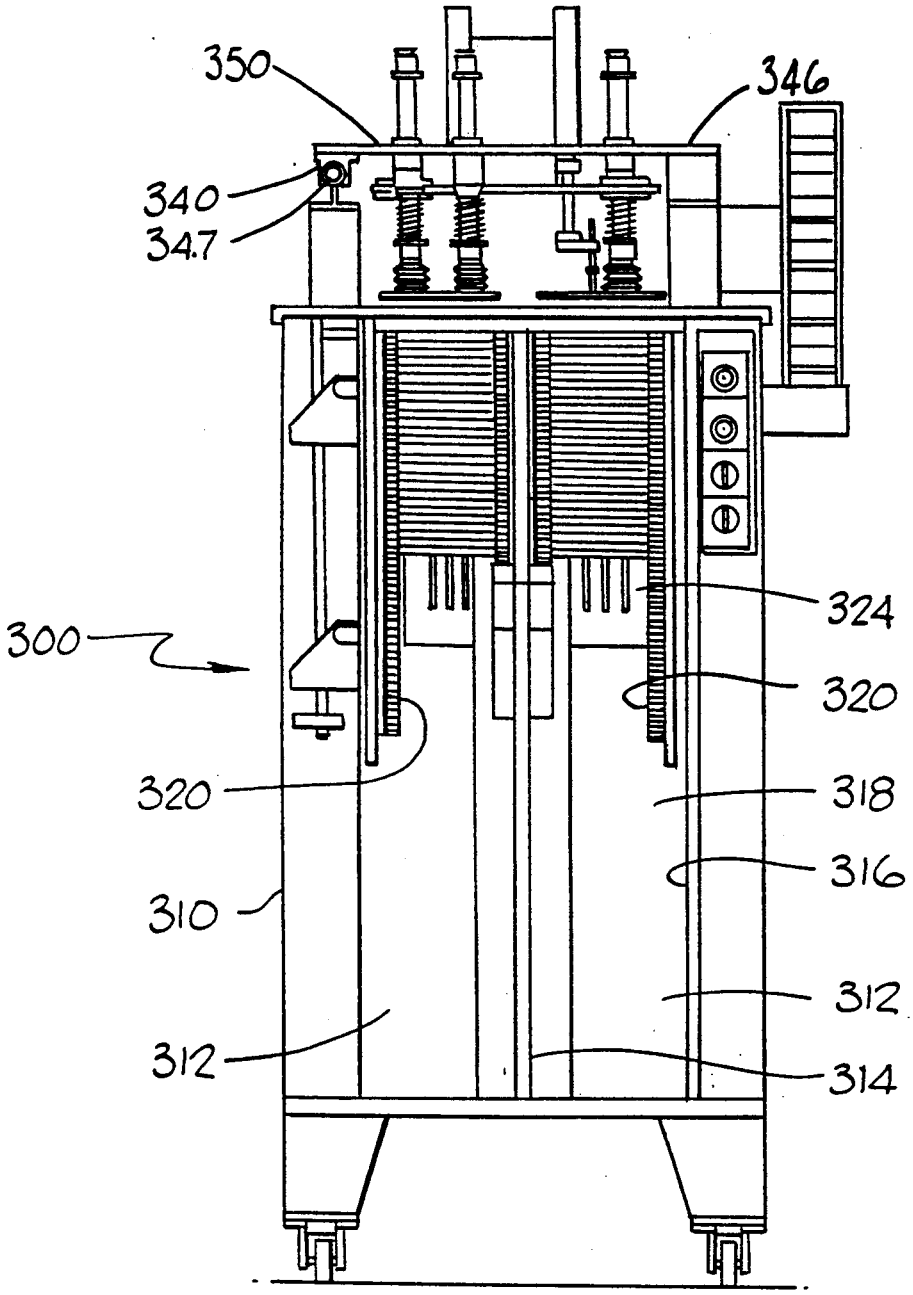
FIG. 9 is a front elevational view of the napkin dispenser of the present invention.
Figure 10:
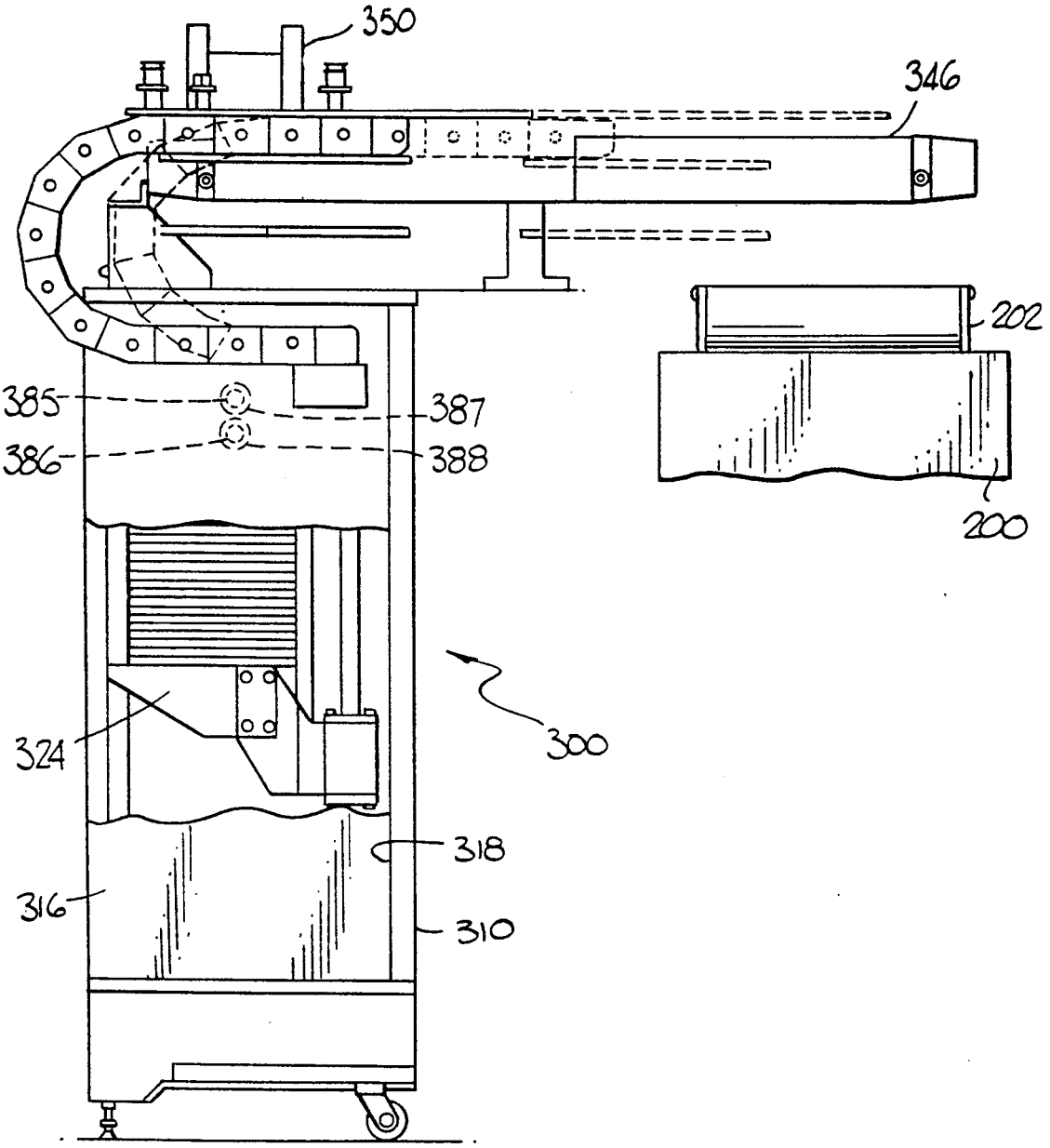
FIG. 10 is a side elevational view of the napkin dispenser end effector assembly.

At the head of the bucket conveyor is an automated bucket filler to add items to the buckets before the collected utensils are deposited into the buckets. In the preferred embodiment, the automated bucket filler is a napkin dispenser 300 and is shown in more detail in FIGS. 8–10. The napkin dispenser includes a housing 310 having two napkin compartments 312 which are separated by a divider 314. Each compartment has a sidewall 316 and a backwall 318. The divider and walls are lined with bristled brushes 320. The distance between the two sidewalls 316 is manually adjustable by a knob engaged with a screw mechanism (not shown) in order to accommodate napkins of varying width. Each napkin compartment has a horizontal napkin rack 324 to hold a stack of napkins.

At the top of the napkin dispenser housing 310 is a tubular track 340 and a dispenser carriage 346 that carries a dispenser end effector assembly 350 from a position over the napkin compartments 312 to a position over the bucket conveyor 200. The dispenser carriage 346 may be pneumatically driven and guided by a bearing set on a shaft 347. The dispenser end effector assembly itself includes a base plate 352 which carries a left pick-up assembly 358 and a right pick-up assembly 360 which operate in unison. Each pick-up assembly 358 and 360 includes a vacuum end effector 362 at opposite corners of the horizontal rectangle formed by the napkin compartments 312 when the compartment doors are shut. Extending from front to back and disposed between the two end effectors of each pick-up assembly 358 and 360 is a placement bar 370 which pushes the picked-up napkins into the buckets of the bucket conveyor. The placement bar 370 is mounted to the end effector assembly and slides up and down thereon by a pneumatic placement bar slide 371. The pick-up assemblies 358 and 360 are mounted on the end effector assembly and are moved up and down by a pneumatic pick-up assembly actuator 361. The vacuum system may include a convergent beam photo eye sensor to verify that a napkin has been picked up by the end effectors by optically sensing the presence of a napkin as the mouths of the end effectors are closed by the napkin.

The napkin rack 324 is vertically adjustable by means of a worm screw and motor (not shown) inside the housing 310. Near the top of the sidewalls of the napkin compartments 312 at the level where the pick-up assemblies are to pick up napkins are a pair of photosensors to detect the height of the napkin stack. On one sidewall is a top photosensor light 385 and a bottom photosensor light 386 which shine light beams through a cutout in the divider 314 to the opposite sidewall to be received by a top photocell 387 and a bottom photocell 388. The top photosensor 385 and 387 is to determine the maximum height of the napkin stack, and the bottom sensor 386 and 388 is to determine the minimum height of the napkin stack. When the beam from the top light 385 is received by the top photocell 387 and is interrupted by the napkin stack, then the stack is at its maximum height. When the beam from the lower light 386 is not received by the lower photocell 388 because it is interrupted by the napkin stack, then the stack is not too low. But if the beam is received by the lower photocell 388, then the stack has dropped below the level of the beam and is too low, and a signal is sent to the height adjustment motor to raise the napkin holder height by turning the worm screw until the top beam is interrupted. In this manner, the top of the napkin stack is maintained between the top and bottom sensors. The height of the napkin rack is continually monitored by a trip switch. If the height reaches a critical predetermined upper level where the stack is very short, the switch is tripped and a signal is sent to activate a short stack indicator such as a light or buzzer to warn the operator that the napkin stack must be replenished. The napkin stack is replenished by manually adding napkins to the stack. If the napkin stack is completely depleted a switch (not shown) sends a signal to lower the napkin rack 324 to its lowest position and to discontinue the placement of napkins.

The napkin dispenser 300 is operated by loading the compartments 312 with napkins. The unit is activated, and the sensors 385 and 387, and 386 and 388, automatically activate the worm screw motor to adjust the height of the holders 324 such that the top of the napkin stack is at a level to allow the top napkin to be picked up. When the computer indicates there are two empty buckets 202 in position on the bucket conveyor 200 to receive napkins, the napkin dispenser pick-up assemblies 358 and 360 are moved downward by the pneumatic pick-up assembly actuator 361 so that the resilient end effector cups 362 contact the top napkins of the napkin stack. Valves in the vacuum system then open to activate the end effector vacuums to attach the napkin to the two end effector cups of each pick-up assembly, and the pick-up assembly actuator returns the pick-up assemblies to the upper position. The bristled brushes 320 drag all but the top napkin off of the end effector cups to ensure that only one napkin is picked up by each assembly 358 and 360.

The carriage moves the entire end effector assembly rearward to position the end effector over the two empty buckets. The vacuum on the end effector cups is released by closing the vacuum valves and the napkins drop off the end effector cups. The placement bars 370 are then lowered by the placement bar actuators 371 This causes the placement bars 370 of each pick-up assembly to enter its respective bucket 202 through the top bucket cut-out, thereby bending the napkin sides along a line coinciding with the placement bar. The placement bars are returned to the upper position, leaving the napkins inside the buckets. The end effector assemblies are then returned to the position over the napkin dispenser by the carriage to await the next signal that there are two empty buckets to be filled, and then the cycle is repeated.

Toward the end of the bucket conveyor may be other machines to add other items to the bucket as they pass. For example, there may be a vibrator dispenser utilizing an optical sensor of a type known in the art to dispense salt or pepper packages or condiment packages. Finally there is an automatic bagging machine 400 as shown in FIG. 4A of a type known in the art, in which a plunger is inserted through the bucket cylinders from one open end and out the opposite open end to transfer the collected utensils and other contents of the bucket from the bucket to the bagger. The bagger then bags the contents of each bag into a plastic bag, seals the bag with a heat sealer or other appropriate means, and stacks or otherwise stores the filled bags for later use.

Figure 11:
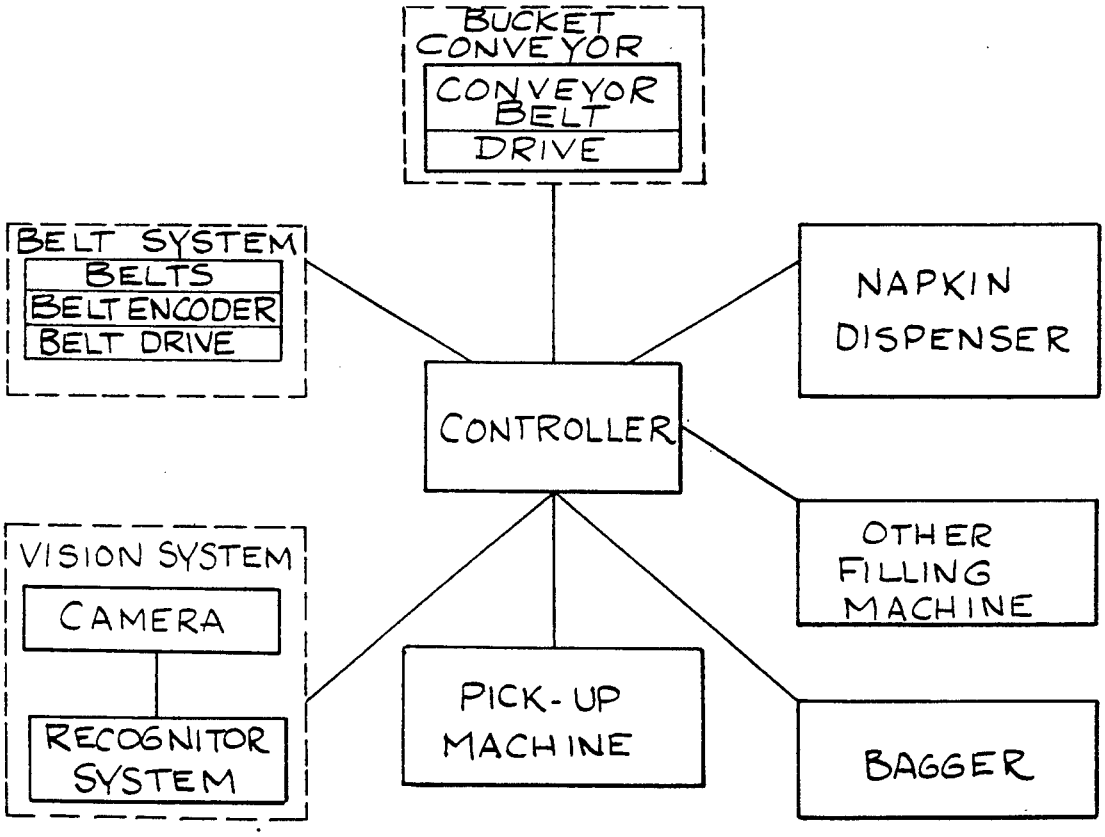
FIG. 11 is a diagrammatic illustration of the operation and control of the invention.

A diagrammatic chart of the overall operation and control of the invention and its principal elements using the computer controller is shown in FIG. 11. The belt 20 is loaded manually by dumping mixed utensils in random orientation onto the inclined infeed conveyor 30. Alternatively, the infeed conveyor 30 may automatically receive utensils that are deposited there, such as by an automatic unloader from a dishwasher. The dumped utensils are carried to the top of the infeed conveyor and fall off the end onto the feed chute 32. They slide down the feed chute 37 which tends to separate the clusters as they drop from the infeed conveyor to the chute. At the end of the feed chute, the utensils drop onto the back straightaway portion 24 of the conveyor belt 20. The utensils are then carried the length of the back straightaway and onto and around the second curved portion 28. The utensils then drop from the second curved portion 28 onto the front straightaway 22 which is at a slightly faster speed than the second curved portion. The speed differential between the second curved portion and the front straightaway tends to further separate the utensils in the longitudinal direction. At any time in the conveyance of the utensils around the belt, the belt drive may receive a signal from the controller to increase or decrease the belt speed depending on whether the utensils are passing under the pick-up machines at a rate that is too slow or too fast. The utensils are for the most part well separated at this point and ready to be picked up by the pick-up machines 100.

As the utensils advance on the front straightaway 22, they pass under the vision system light shield 55 and over the light box 38. The periodic activation of the light strobe shines flashes of light through the light box that diffuse up through the light box glass plate 46 and through the translucent front straightaway section 22. The image of the silhouetted utensils is recorded by the video camera and can be processed by the recognition software of the computer to identify and store the type, location and orientation of utensils. Any utensils or other objects in the image that cannot be so identified are ignored. The recorded longitudinal location of the utensils is continually updated to account for the longitudinal movement of the belt.

The utensils continue to be carried until they reach the pick-up zone for the pick-up machine 100. The pick-up machine is programmed in the preferred embodiment so that an inquiry is initially made whether the collection pan is lacking a knife. If so, then the light box is activated and the image is recorded by the video camera and processed to search for a knife. If a knife is found, then a signal is sent to the pick-up machine indicating that a knife was found and indicating the position and orientation of the knife. The pick-up machine then picks up the knife and places it in the collection pan. A similar process is followed for other individual utensils, such as a fork and spoon. If the collection pan is missing a fork, then an image is scanned for a fork and if a fork is found then the fork position and orientation is sent to the pick-up machine and the pick-up machine picks it up. The image that is searched for the fork is the same one that was searched for a knife if the utensils shown in that image are still within reach of the pick-up machine and there are still objects in that image that are recognizable. Otherwise, the light box is activated again and a new image is made, processed and searched. If the collection pan is missing a spoon, then the image is scanned for a spoon and if a spoon is found then the spoon position and orientation is sent to the pick-up machine. In all of this, it is important to note that the preferred embodiment indexes the longitudinal position of recognized images to the belt travel, so that the position as indicated in the vision system is continually updated to reflect the movement of the belt. When the collection pan has a full set of utensils, it is emptied into its next dedicated bucket at the bucket filling position, and the computer is notified that the particular bucket into which the utensils were dispensed is now unavailable for further utensils from the pick-up machines. The process then is repeated beginning with the inquiry whether the collection pan has a full set of utensils.

Following each pick-up, a check is made whether the pick-up was successful by a vacuum switch that senses the pressure drop when the end effector cups are occluded. If the pick-up was successful, a signal is sent to the vision system indicating that the collection pan no longer needs the utensil that was picked up. If the pick-up was unsuccessful, a signal is sent to the vision system indicating that the collection pan still needs the utensil that was to be picked up.

The same process is then performed for any other utensil to be collected into the collection pan. An inquiry is made whether the collection pan needs the utensil; if so, then the last image is searched for the utensil if the utensils in the last image are still within reach of the pick-up machine and there are still any recognizable objects in the image, or a new image is generated and searched if the utensils in the old image are no longer within reach of the pick-up machine or there are no more recognizable objects in the image. Once the sought utensil is found, the pick-up machine attempts to pick-up the utensil and place it into the collection pan and the vision system is then signalled that the collection pan no longer needs that utensil if the pick-up is successful or that the collection pan still needs that utensil if the pick-up is unsuccessful.

Throughout the operation, a count is kept of the number of recognizable objects that pass through the vision system per unit of time. If that number drops below a predetermined minimum, then a signal is automatically sent to speed up the conveyor belt. If that number exceeds a predetermined maximum, then a signal is sent to slow the conveyor belt.

In this manner the buckets on the bucket conveyor are filled with utensils as the bucket conveyor conveys the utensil-filled buckets past the pick-up machines 100. There may be other filling machines alongside the bucket conveyor at any point prior to the bagging machine to add other items, such as salt and pepper or condiments. These other filling machines may be automated and may operate in coordination with the movement of the bucket conveyor, with the filling by the pick-up machines, or with the operation of other filling machines.

After the last filling machine is a bagging machine (not shown). The bagging machine is of a type known in the art which includes a plunger to push the utensils out of the filled bucket and into a hopper where they are enveloped in a plastic film bag which is heat sealed together and then the sealed bag is stacked in a holding bin.

At the start of the bucket conveyor is the automatic napkin dispenser. A signal is sent by the system controller to the napkin dispenser that two empty buckets are in position to receive napkins. The napkin and end effector assembly then picks up a pair of napkins from the pair of napkin stacks in the pair of napkin compartments, lifts them as the compartment brushes tend to hold back any second napkins that adhere to the top ones, moves the napkins to a position over the empty buckets by moving the end effector assembly along the carriage and lowers the placement bars 370 so that the napkins are forced into the empty bucket. The placement bars 370 are then raised to leave the napkins in the buckets. The napkin dispenser then waits for another signal that there are two empty buckets in place to receive napkins, and the process is repeated. The level of the napkin stacks within the napkin compartments is kept within proper reach of the end effectors by the sensor and adjustment mechanism.

What is claimed is:

1. An apparatus for packaging utensils of a plurality of types that are randomly positioned and oriented on a utensil deposit site comprising:

transport means for transporting the utensils from the utensil deposit site to an identification site and to a pick-up site;

means for identifying the utensils by type at the identification site;

means for picking up one by one a collection of utensils from the pick-up site, said collection including a predetermined number of utensils greater than one and a predetermined number of utensil types greater than one; and a collection site within reach of the pick-up means for collecting the collection of utensils.

2. The apparatus of claim 1, wherein the transport means includes a conveyor belt system with at least a first conveyor belt, the first conveyor belt having an identification site and a pick-up site.

3. The apparatus of claim 2, wherein the conveyor belt system includes a second conveyor belt cooperatively engaged with the first conveyor belt so that utensils are transported on the second conveyor belt and from the second conveyor belt onto the first conveyor belt.

4. The apparatus of claim 3, wherein the conveyor belt system includes a third and a fourth conveyor belt, and the conveyor belts are arranged in a continuous loop so that utensils that are not picked up from the first conveyor belt by the pick-up means are transported around the continuous loop.

5. The apparatus of claim 4, wherein the first and second conveyor are substantially straight and parallel to one another and transport the utensils in opposite directions, and the third and fourth conveyors are between the first and second conveyors in the continuous loop and are substantially half circles with an input end for receiving utensils from the preceding conveyor in the continuous loop and an output end for transporting utensils to the next conveyor in the continuous loop.

6. The apparatus of claim 2, wherein the transport means includes an infeed conveyor for receiving utensils, the infeed conveyor being positioned to transport the utensils to and deposit the utensils on the conveyor belt system.

7. The apparatus of claim 6, wherein the infeed conveyor has an output end positioned at an elevation above the conveyor system, and wherein the transport means includes separating means between the output end of the infeed conveyor and the conveyor system for separating clusters of utensils as they drop from the infeed conveyor output end onto the conveyor system.

8. The apparatus of claim 7, wherein the separating means includes a chute inclined from an upper input end to receive utensils from the infeed conveyor to a lower output end to deposit utensils onto the conveyor system, the incline and surface of the material being such that utensils slide down from the upper input end to the lower output end.

9. The apparatus of claim 2, wherein the conveyor belt system includes a plurality of conveyor belts in series, the speeds of at least two adjacent conveyor belts being different so as to separate clustered utensils moving from one of said adjacent belts to the other.

10. The apparatus of claim 1, wherein the identifying means includes a video camera positioned to record an image of the identification site and image recognition means to process said image to identify objects in the image by comparing the image objects with a pre-existing library of objects.

11. The apparatus of claim 10, wherein the transport means includes a translucent conveyor belt, and wherein the identification site and pick-up site are portions of said translucent conveyor belt, and wherein the identification means includes a light box to backlight said translucent conveyor belt at the identification site so that the video image shows silhouettes of the utensils.

12. The apparatus of claim 11, wherein the light box includes a bottom and a front side in the direction of utensil travel and aback side in the direction opposite utensil travel, and a first light bar extending along the corner between the front side and the bottom and a second light bar extending along the corner between the back side and the bottom, each of the light bars oriented to shine a light beam into the light box.

13. The apparatus of claim 12, wherein the light bars are positioned to shine a light beam into the light box at an angle of 10 to 30 degrees above horizontal.

14. The apparatus of claim 11, wherein the light bars are lit by a strobe light.

15. The apparatus of claim 10, wherein said identification means includes means for identifying the position and orientation of utensils.

16. The apparatus of claim 10, wherein the identification means includes a light shield having an upper opening that opens to the video camera and a lower opening that opens to the identification site, for shielding extraneous light from the video camera.

17. The apparatus of claim 16, wherein the light shield is pyramidal shaped with four sides, and a light absorbing interior surface.

18. The apparatus of claim 1, wherein the pick-up means includes an end effector assembly, a frame, and longitudinal and lateral positioning means and orientation means connecting the end effector assembly to the frame while allowing adjustment of the end effector assembly in the transport means longitudinal and lateral directions and adjustment of the end effector assembly orientation.

19. The apparatus of claim 18, wherein the longitudinal and lateral positioning means include belt-driven carriages that travel within a fixed track, the track of one of the longitudinal and lateral positioning means being mounted to the carriage of the other of the longitudinal and lateral positioning means.

20. The apparatus of claim 18, further comprising control means for controlling the position of the end effector assembly on the longitudinal end lateral positioning means and the orientation means, the control means being in electronic communication with the identification means.

21. The apparatus of claim 20, further comprising measuring means for measuring the travel of the transport means, the measuring means being in electronic communication with the control means.

22. The apparatus of claim 21, wherein the transport means includes a conveyor belt and the measuring means includes a wheel that is turned by the conveyor belt.

23. The apparatus of claim 20, further comprising means for directing the pick-up means to pick up said collection of a plurality of utensils of a plurality of type and to group them in the collection site, and means for releasing the collection into a placement site.

24. The apparatus of claim 18, wherein the end effector assembly includes a housing, vertically adjustable struts connecting the housing to one of the longitudinal and lateral positioning means and orientation means, and at least one end effector operatively connected to the housing for picking up utensils.

25. The apparatus of claim 24, wherein the end effector is pivotally and slidably attached to the housing at a first point and pivotally attached to a pivot arm that pivots on the housing at a second point, whereby the pivoting of the pivot arm at the second point raises the actuator arm and causes it to pivot and slide upward at the first point so that the end effectors attached to the actuator arm move in an arc upward and toward the housing.

26. The apparatus of claim 25, wherein the collection site includes a collection pan on the housing for releasably holding a plurality of utensils, the collection pan being positioned on the housing beneath the end effectors when the end effectors are arced upward and toward the housing, so that the release of a utensil from the end effector causes the utensil to drop into the collection pan.

27. The apparatus of claim 26, wherein the collection pan has releasable trap doors at the bottom, whereby the release of the trap doors allows the collected utensils to fall from the collection pan.

28. The apparatus of claim 27, wherein the vertically adjustable struts are operatively connected to pneumatic means for activating them up and down, the pivot arm is operatively connected to pneumatic means for pivoting it to raise and lower the end effectors, and the collection pan trap doors are operatively connected to pneumatic means for opening and closing them.

29. The apparatus of claim 24, wherein the end effector assembly includes two end effector cups operatively connected to the housing for picking up utensils, the end effector cups being vacuum actuated to adhere to the utensil and being resiliently deformable in the axial direction.

30. The apparatus of claim 1, further comprising a set of movable placement sites in operative engagement with the apparatus for receiving utensil collections from the collection site.

31. The apparatus of claim 30, wherein said placement sites are positioned on a movable placement conveyor, the movement of which is coordinated with the movement of the transport means.

32. The apparatus of claim 30, further comprising an automated napkin dispenser operatively connected to the set of placement sites for placing a napkin into each placement site.

33. The apparatus of claim 31, further comprising automated filling means for filling each placement site with a determined number of predetermined type of item other than utensils.

34. The apparatus of claim 32, wherein the napkin dispenser is located such that the napkins are placed into the placement sites before the utensils are placed into the placement site.

35. The apparatus of claim 34, wherein the napkin dispenser includes a housing for holding the napkin, a napkin rack for holding a stack of napkins, and an automated napkin end effector assembly for picking up a napkin from the napkin stack and placing it into the placement site.

36. The apparatus of claim 35, wherein the napkin rack includes means for automatically adjusting the rack height to maintain the height of the top of the napkin stack substantially constant as napkins are removed from the napkin stack.

37. The apparatus of claim 36, wherein the napkin end effector assembly includes a track and a carriage movably mounted on the track between a position over the napkin stack to a position over the placement site.

38. The apparatus of claim 36, wherein the adjusting means includes a first photosensor unit on the napkin dispenser housing with a light-generating element and a light-receiving element, positioned so that the light-generating element shines a light beam over the top of the napkin stack toward the light-receiving element and the beam is received the light-receiving element if the stack is too low but is intercepted by the napkin stack and not received by the light-receiving element if the napkin stack is not too low.

39. The apparatus of claim 38, wherein the adjusting means includes a second photosensor unit in the napkin dispenser housing with a second light-generating element and a second light-receiving element, positioned so that the second light-generating element shines a light beam into the napkin stack toward the second light-receiving element and the light beam is received by the second light-receiving element of the napkin stack is too low but is intercepted by the napkin stack and not received by the second light-receiving element if the napkin stack is not too low.

40. The apparatus of claim 37, wherein the housing includes a napkin compartment to hold the napkin stack, the napkin compartment having an adjustable width to accommodate napkin stacks of varying width and bristle brushes on at least one wall to separate the napkins into a single napkin as they are picked up.

41. The apparatus of claim 37, wherein the napkin end effector assembly includes at least one vacuum actuated napkin end effector cup that is mounted to the napkin end effector assembly carriage by vertically movable mounting means, to pick up and lift a napkin off the top of the napkin stack.

42. The apparatus of claim 41, wherein the mounting means includes a pneumatically operated napkin end effector cup actuator.

43. The apparatus of claim 42, wherein the napkin end effector assembly includes at least two vacuum actuated napkin end effector cups mounted to the napkin end effector assembly carriage by said mounting means, and also includes a placement bar extending between the cups in the napkin longitudinal direction to assist in the cup holding the napkin and to bend the napkin as it is placed at the placement site.

44. The apparatus of claim 43, wherein the napkin placement bar is movable in the vertical direction to place the napkin from the end effector cups into the placement site.

45. A method for collecting and packaging a plurality of utensils of a plurality of types, comprising:

placing said utensils on a conveyor belt system;

conveying the utensils to a site on the belt system for identification by type, location and orientation;

conveying the utensils to a site for being picked up;

picking up and collecting into a collection site a set of said utensils using a pick-up mechanism, the set including a predetermined number of utensils greater than one of each of a predetermined number of utensil types greater than one;

depositing said collected set of utensils into a placement site; and removing the collected set of utensils from the placement site and bagging them into a package.

46. The method of claim 45, wherein said placement site includes a plurality of placement containers on a container conveyor belt, and further comprising periodically advancing the container conveyor belt to position placement containers that have not received utensil sets within reach of the pick-up mechanism.

47. The method of claim 45, further comprising separating clusters of the utensils before they are identified.

48. The method of claim 47, wherein said belt system includes a set of belts comprising a continuous loop, and said separation step includes depositing the utensils onto an inclined chute over one of the belts.

49. The method of claim 48, wherein said separation step includes running two adjacent belts at different speeds.

50. The method of claim 45, wherein said identification step and said pick-up step includes:

(a) establishing the desired set of utensils to be collected;

(b) inquiring whether the collection site has all the utensils of a given type in said desired set;

(c) if the collection site does not have all the utensils of said type, then identifying such a utensil on the belt system, and picking up said utensil and placing it into the collection site;

(d) if the collection site has all the utensils of said given type in said desired set, then choosing a new given type in said desired set, and repeating steps (b) and (c) until all utensils of all given types in said desired set are in the collection site; and (e) when all utensils of all given types in said desired set are in the collection site, then emptying the collection site into the placement site for packaging.

51. The method of claim 50, wherein said identification step is accomplished with a video camera that records images of a portion of the belt system, and wherein an image from which a utensil is identified for being picked up is recorded by the video camera when there is no identifiable utensil of the type being sought within reach of the pick-up mechanism in any preceding image.

52. The method of claim 46, further comprising placing napkins into the placement containers to be packaged with the utensils, said napkin placement step comprising:

waiting for placement container on said container conveyor belt that is missing a napkin;

removing a napkin from a napkin stack in a napkin dispenser and placing it into said container missing a napkin; and periodically raising said napkin stack so that the napkin stack top stays at substantially a constant height.

53. The method of claim 52, wherein the napkin dispenser includes a napkin compartment to hold a napkin stack and a napkin end effector assembly to pick up napkins from the stack and place them into the placement containers, the napkin end effector assembly being movably mounted to move from a position to pick up napkins from the napkin stack to a position to place napkins into the placement containers.

* * * * *